US006758348B2

(12) United States Patent
Adkins

(10) Patent No.: US 6,758,348 B2
(45) Date of Patent: Jul. 6, 2004

(54) SPACE SAVING DISH STRAINER

(76) Inventor: Kathleen J. Adkins, 5252 E. County Rd. 100 N., Avon, IN (US) 46123

( * ) Notice: Subject to any disclaimer, the term of this patent is extended or adjusted under 35 U.S.C. 154(b) by 0 days.

(21) Appl. No.: 10/317,724

(22) Filed: Dec. 12, 2002

(65) Prior Publication Data

US 2003/0080074 A1 May 1, 2003

Related U.S. Application Data

(63) Continuation-in-part of application No. 09/836,596, filed on Apr. 5, 2001, now abandoned.

(51) Int. Cl.[7] ..... A47F 5/00

(52) U.S. Cl. ..... 211/41.6; 211/118; 211/100; 211/126.7; 211/126.8

(58) Field of Search ..... 211/117, 118, 211/119, 41.3, 41.4, 41.5, 41.6, 100, 126.7, 126.8

(56) References Cited

U.S. PATENT DOCUMENTS

| | | | | |
|---|---|---|---|---|
| 542,912 | A | | 7/1895 | Wood |
| 1,037,073 | A | | 8/1912 | Sonnemann |
| 1,446,592 | A | | 2/1923 | Smythe |
| 1,581,427 | A | | 4/1926 | Cummings |
| 1,860,617 | A | | 5/1932 | Krause |
| 2,070,826 | A | | 2/1937 | Dick |
| 2,538,233 | A | | 1/1951 | Brandstrom |
| 2,657,810 | A | * | 11/1953 | Garrick |
| 2,697,525 | A | | 12/1954 | Breneman |
| 3,442,395 | A | | 5/1969 | Taylor |
| 3,663,080 | A | | 5/1972 | Ayers |
| 3,853,293 | A | | 12/1974 | Larson |
| 3,889,837 | A | | 6/1975 | Wilson |
| 3,952,875 | A | | 4/1976 | Lombardo |
| 4,025,013 | A | | 5/1977 | Anantharaman |
| 4,221,288 | A | | 9/1980 | Rae |
| 4,325,528 | A | | 4/1982 | Martin |
| 4,329,789 | A | * | 5/1982 | Erickson |
| D268,878 | S | | 5/1983 | Taylor |
| 4,436,352 | A | | 3/1984 | Okada et al. |
| 4,456,125 | A | | 6/1984 | Chap |
| 4,756,582 | A | | 7/1988 | Heien |
| 4,848,620 | A | | 7/1989 | Chap |
| 5,195,426 | A | * | 3/1993 | Thuli ..... 211/118 X |
| 5,485,927 | A | | 1/1996 | Hubbard |
| 5,542,530 | A | | 8/1996 | Freelander |
| 5,794,797 | A | | 8/1998 | Kuntz |
| 5,836,109 | A | | 11/1998 | Kunz et al. |
| D416,409 | S | | 11/1999 | Matthews et al. |
| D417,052 | S | | 11/1999 | Ancona et al. |
| 6,021,906 | A | | 2/2000 | Heien |
| 6,170,676 | B1 | | 1/2001 | Patadia et al. |
| 6,286,691 | B1 | | 9/2001 | Oberhaus et al. |
| 6,375,137 | B1 | | 4/2002 | McQuade et al. |
| 6,637,609 | B2 | * | 10/2003 | Stevens ..... 211/118 |

* cited by examiner

*Primary Examiner*—Robert W. Gibson, Jr.
(74) *Attorney, Agent, or Firm*—Woodard, Emhardt, Moriarty, McNett & Henry, LLP

(57) ABSTRACT

A dish drying apparatus including a cabinet that houses a dish strainer. In use, the strainer hangs from an arm member that extends from the cabinet and the strainer includes multiple dish racks that are connected to one another by flexible bands. When not in use the inventive dish strainer can be collapsed and folded into a cabinet to which it is attached. Advantageously, in preferred embodiments, the arm member is extendable and vertically adjustable, such that placement of the cabinet with respect to the sink over which the strainer is intended to hang is not critical.

20 Claims, 14 Drawing Sheets

SPACE SAVING DISH STRAINER

RELATED APPLICATIONS

This is a continuation-in-part application filed pursuant to 37 C.F.R. § 1.53 (b) and which claims priority under 35 U.S.C. § 120 to U.S. application Ser. No. 09/836,596, filed Apr. 5, 2001, abandoned.

FIELD OF THE INVENTION

The present invention relates generally to devices used for drying dishes and more particularly to portable devices for drying dishes.

BACKGROUND

Dish strainers are well known in the art. A traditional prior art dish strainer is made of a grid of plastic coated wires which forms a basket sized to fit into a sink. An example of the same is disclosed by W. D. Taylor in U.S. Pat. No. 3,442,395. There are several disadvantages to dish strainers that fit into a rinse sink. First, the strainer necessarily occupies the sink space. Thus, when dishes are positioned on the strainer and drying, the sink cannot be used. Additionally, if the sink which the dish strainer occupies is one of a two-sink pair, use of the other sink may undesirably cause water to splash onto the dishes that are drying. Furthermore, when such a conventional dish strainer is not being used, it occupies space in the sink. Moreover, the walls of the sink in which the strainer sits restrict airflow around the dishes and cause increased drying time.

It is also known to place dish strainers on a counter top instead of in the sink, such dish strainers typically being angled to drain into the sink. An example of such a dish strainer is shown and described in U.S. Pat. No. 1,446,592 to R. M. Smythe. The disadvantage of the counter top dish strainer is that it takes up valuable counter space, which is especially disadvantageous in small kitchens with little counter space. Furthermore, the counter may become stained with water spots in the location the dish strainer is placed. Bacteria, mold, mildew and the like may also from on the counter from water which drains from the dishes.

To address the problem of a dish strainer occupying valuable counter space, U.S. Pat. No. 5,485,927 (Hubbard) discloses a dish strainer that is pivotably attached to a wall and which pivots upward and away from the counter top when not in use. One drawback of the device of the '927 patent is that it occupies as much space when in its storage position as it does in its use position. Dish strainers that fold into a cabinet are also known in the art and examples of the same are described in U.S. Pat. No. 2,538,233 (Brandstorm) and U.S. Pat. No. 4,436,352 (Okada et al.). While an improvement over traditional strainers, these cabinet-type dish strainers have drawbacks. For example, the device described in the '352 patent is overly complex and requires a relatively large cabinet. The cabinet door for the device shown in the '233 patent undesirably doubles as a surface on which water drains when the strainer is in use. Furthermore, while the device of the '233 patent conveniently folds away, the dish strainer disclosed is substantially the same size in its stored and use positions. Further, the device of the '233 patent is impractical for use in Campers and RV's where space is limited.

What is needed is a space saving and portable dish strainer that overcomes that the drawbacks of the prior art noted above.

SUMMARY OF THE INVENTION

The present invention provides a dish drying apparatus including a cabinet that houses a dish strainer. In use, the strainer hangs from an arm member that extends from the cabinet and the strainer includes multiple dish racks that are connected to one another by flexible bands. When not in use, the dish strainer can be collapsed, pivoted upwardly, and stored within the cabinet. Advantageously, in preferred embodiments, the arm member is extendable and vertically adjustable, such that placement of the cabinet with respect to the sink over which the strainer is intended to hang is not critical.

In one form thereof, the present invention provides a dish drying apparatus comprising a cabinet. A dish strainer is movably attached to the cabinet, and the dish strainer further comprises a plurality of nestable racks connected to one another. The dish strainer has a storage position in which the racks are nested and the strainer is disposed within the confines of the cabinet. The dish strainer also has a use position in which the racks are spaced apart and disposed exteriorly of the cabinet. In this manner dishes may be supported on the dish strainer in the use position and the strainer may be stored within the cabinet in the storage position.

In a preferred form, the dish drying apparatus further comprises an arm member having a first end thereof pivotably attached to an inside wall of the cabinet and having a second end thereof attached to the dish strainer, the dish strainer hanging from and supported by the arm member in the use position. More preferably, the arm member is extendible, in one preferred embodiment by means of telescopic segments. In another preferred form, the height of the arm member with respect to the cabinet is adjustable by means of a pair of tracks having teeth which engage a plate in several vertical positions.

In another preferred form, the inventive dish drying apparatus further includes a collapsible basket disposed intermediate two of the racks. The basket provides a container for holding flatware within the dish strainer.

In another preferred form, the dish strainer further comprises frame members disposed intermediate the racks. The frame members provide a framework for holding dishes in place within the dish strainer.

One advantage of the present invention is that it provides a dish strainer that can be conveniently positioned over a rinse sink to dry dishes, and then collapsed, folded into and concealed in a relatively small cabinet when not in use. Similarly, because the inventive dish strainer collapses to only a small fraction of its use size, the depth of the cabinet is quite small and occupies little space within the kitchen in which it is installed.

Another advantage of the present invention is that it frees up valuable counter space in small kitchens. With the present invention, when the dish strainer is not being used, it folds away into a relatively small cabinet. On the other hand, even when being used, the inventive dish strainer is suspended over the sink, and thus does not occupy space on the counter or in the sink.

Still another advantage of the dish strainer of the present invention is that the strainer is suspended above the counter, thereby maximizing the airflow surrounding the dishes, in turn reducing the time required to dry them.

Still another advantage of the present invention is that suspending the dish strainer above the counter reduces the amount of water than collect thereon, and therefore reduces the possibility of bacteria, mildew and other such substances contaminating the dish strainer.

BRIEF DESCRIPTION OF DRAWINGS

The above-mentioned and other advantages of the present invention, and the manner of obtaining them, will become more apparent and the invention itself will be better understood by reference to the following description of the embodiments of the invention taken in conjunction with the accompanying drawings, wherein.

Corresponding reference characters indicate corresponding parts throughout the several views.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
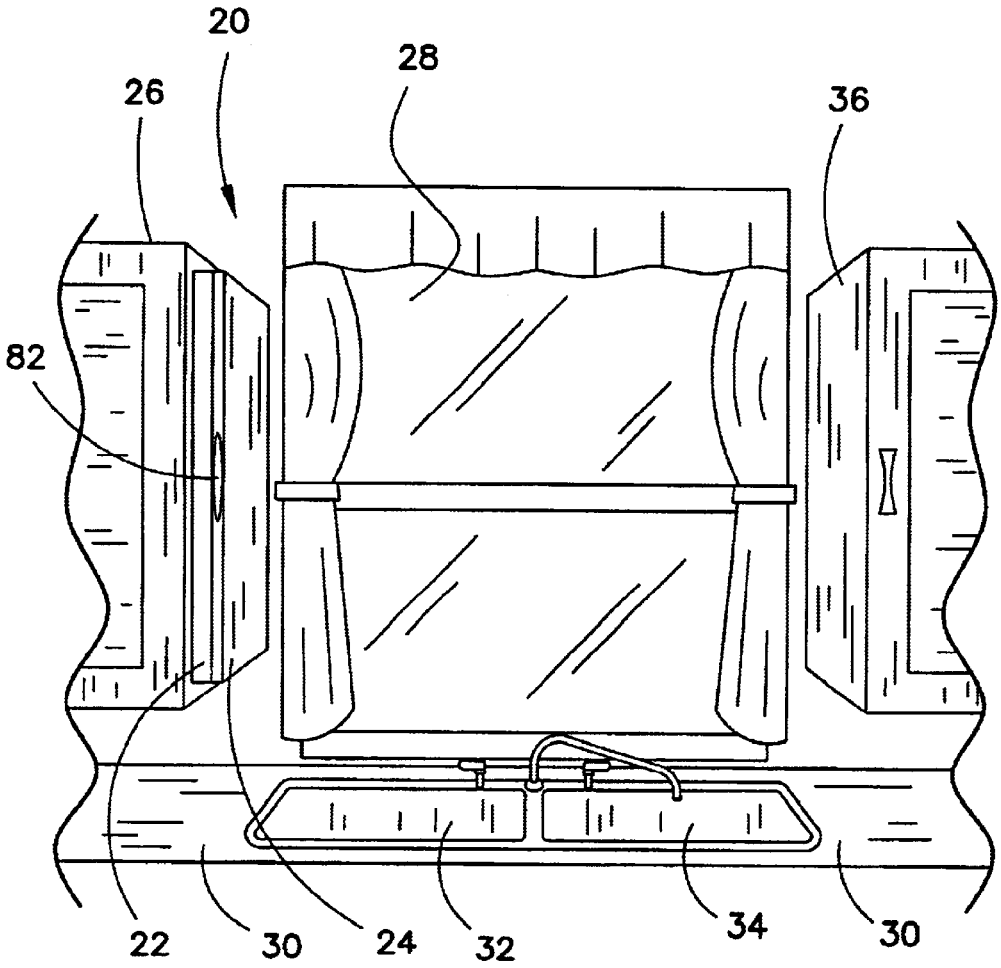
FIG. 1 is a perspective view illustrating the device of the present invention in one intended environment, the device shown in its storage position.
Figure 2:
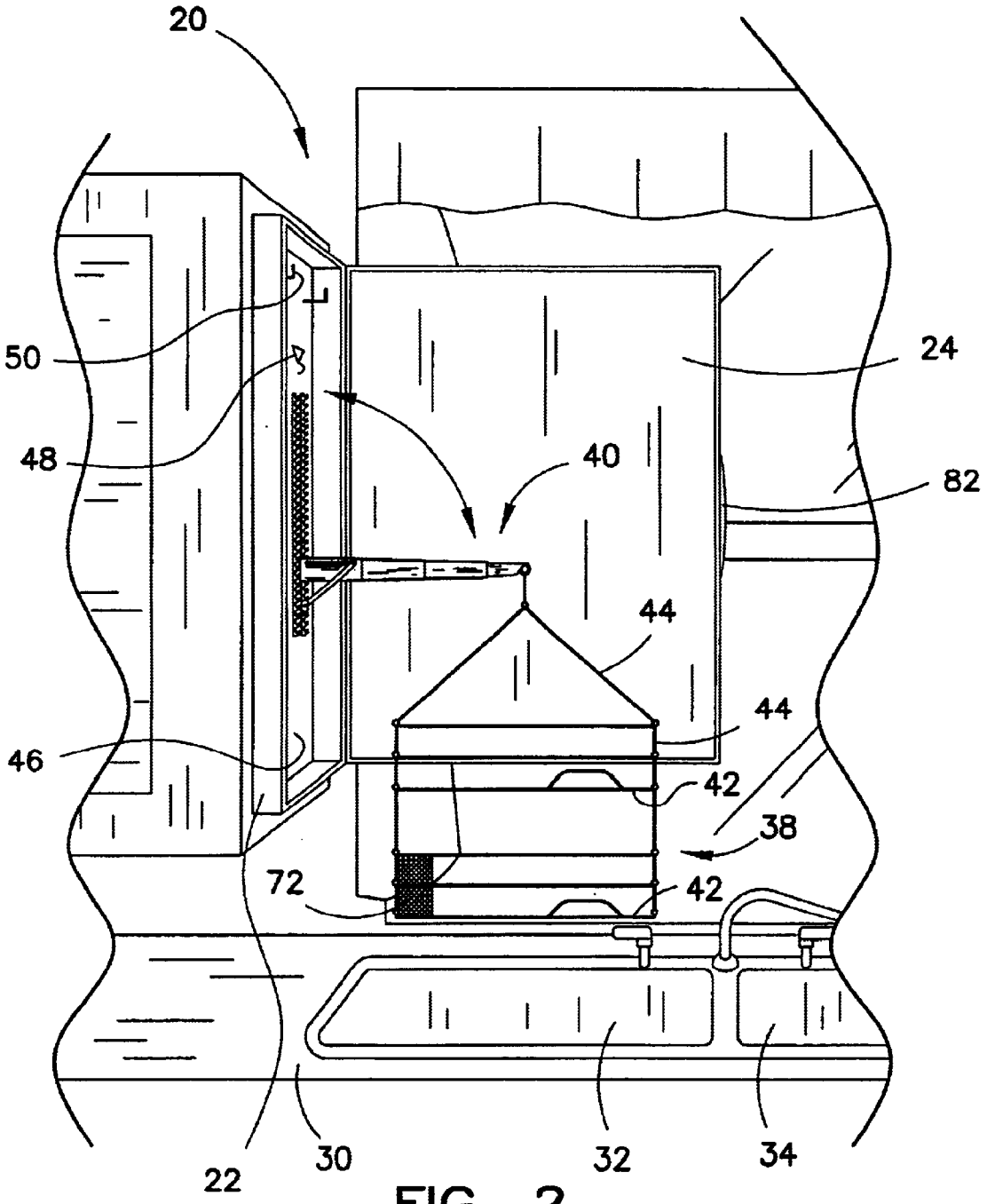
FIG. 2 is a perspective view of the device of FIG. 1, shown in its use position.
Figure 9:
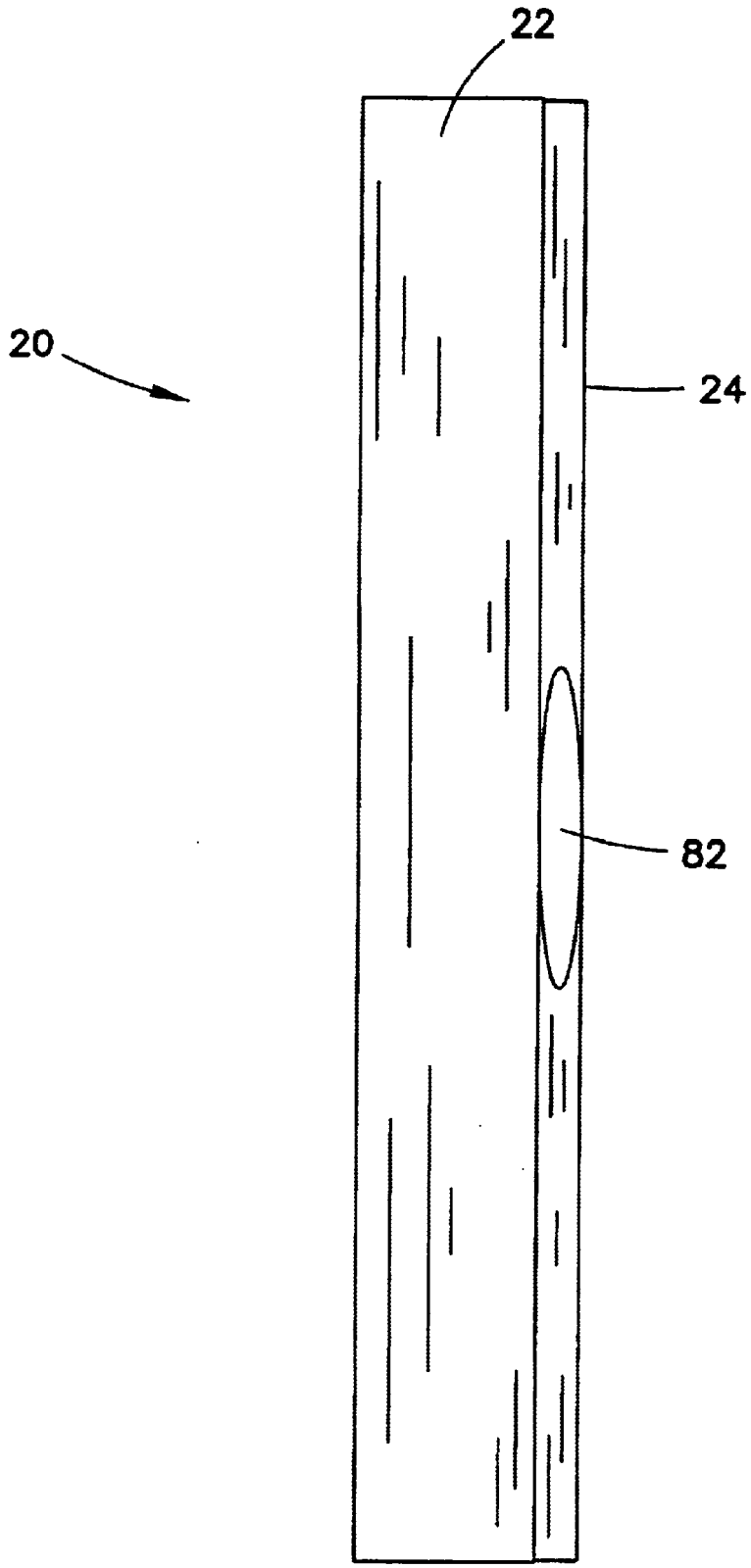
FIG. 9 is a side view of the cabinet that houses the dish strainer in accordance with one embodiment of the present invention.

Turning now to FIGS. 1 and 2, apparatus 20 is shown in one intended environment. Apparatus 20 includes cabinet 22 having a door 24 hingedly attached thereto and an indented handle 82 (see FIG. 9) to facilitate opening door 24. Apparatus 20 is affixed to another kitchen cabinet or wall 26 by conventional means. The environment for device 20 includes window 28, counter 30, rinse sink 32 and wash sink 34. Optionally, depending upon preference, a right-handed apparatus 20 (not shown) could be mounted to cabinet 36, on the right hand side of window 28.

With continued reference to FIGS. 1 and 2, particularly FIG. 2, the dish drying apparatus 20 includes dish strainer 38 movably attached to cabinet 22 by means of arm member 40 described below. Dish strainer 38 includes a plurality of nestable racks 42 that are connected to one another by flexible bands 44. FIG. 2 depicts the "use" position of dish strainer 38, in which racks 42 are spaced apart and disposed exteriorly of cabinet 22. As described in more detail below, arm member 40 has one end pivotably attached to inside wall 46 of cabinet 22 and the other end attached to dish strainer 38, which hangs from and is supported by arm member 40 in the use position. Inside wall 46 includes a latch 48 which detachably receives arm member 40 and holds the same in place in the storage position. Dish stainer 38 hangs in place from hooks 50 when stowed in cabinet 22.

Figure 3:
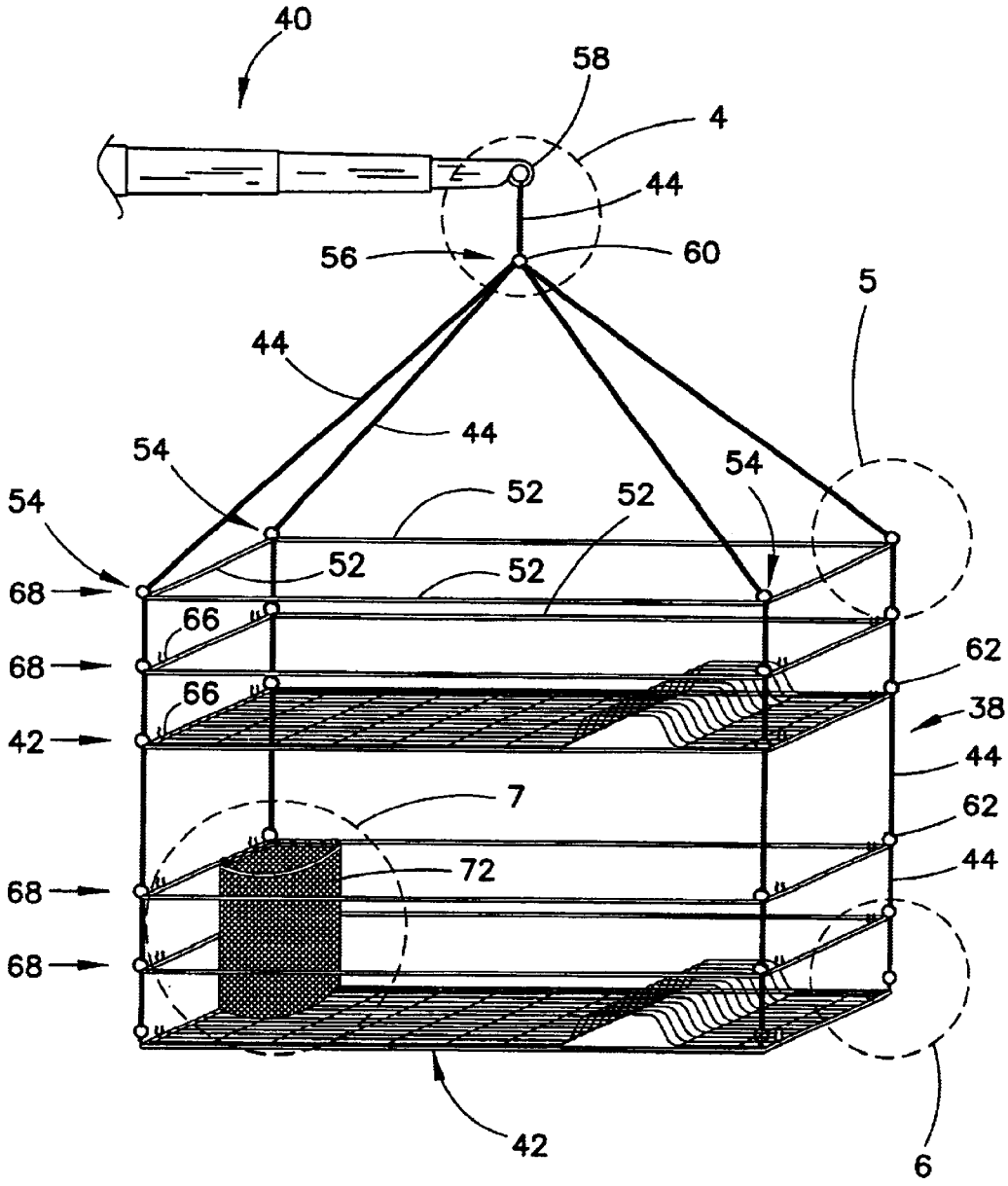
FIG. 3 is a perspective view of a dish strainer in accordance with one embodiment of the present invention.
Figure 4:
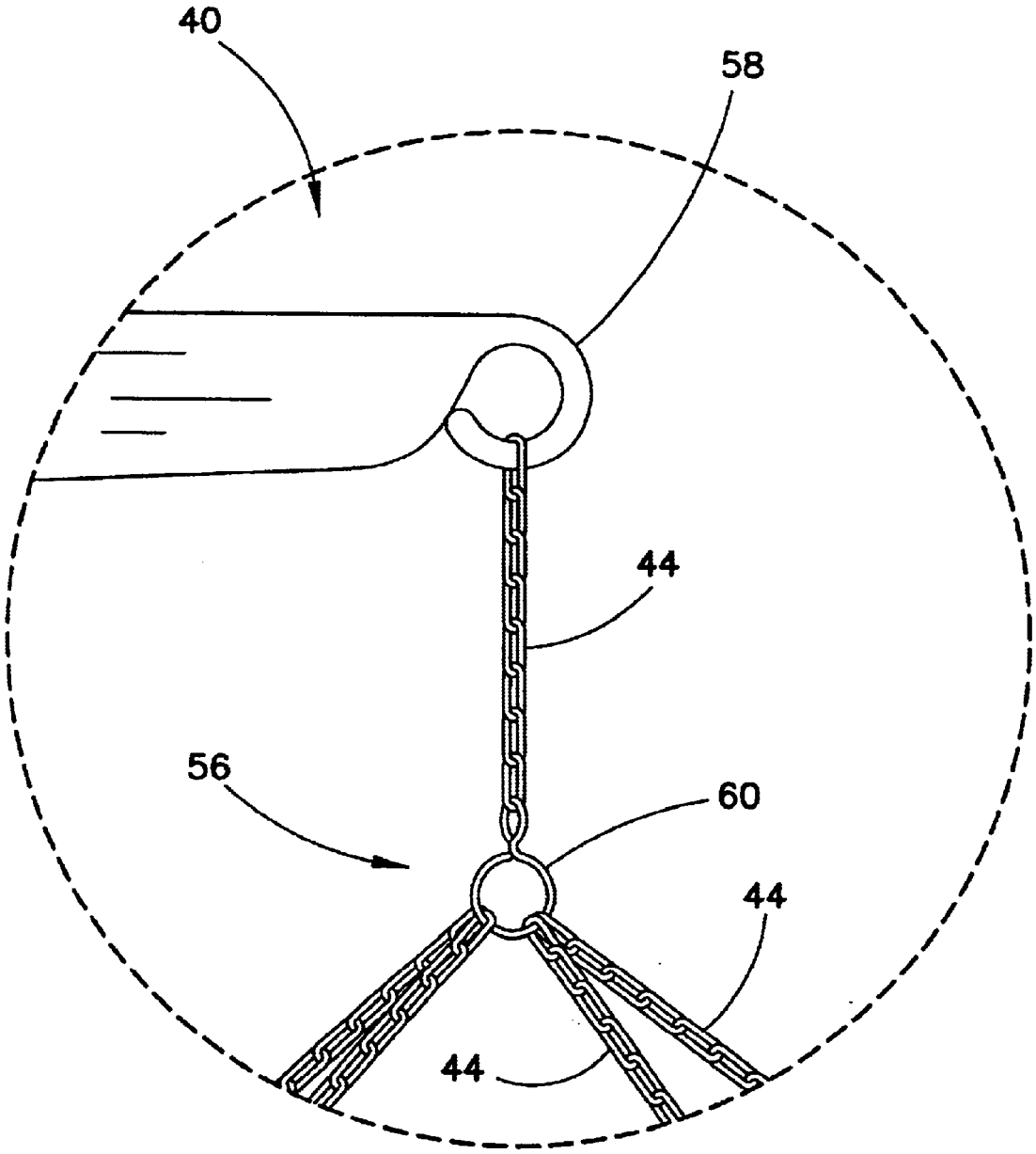
FIG. 4 is a fragmentary exploded perspective view of the connection of the dish strainer to the arm member in accordance with the present invention.

Turning now to FIG. 3, the details of dish strainer 38 can be appreciated. As noted, racks 42 are spaced apart in the use position as shown. The racks define a periphery having corners 54, and a flexible band 44 extends from each corner 54, converging in common point 56 which is disposed substantially centrally with respect to dish strainer 38, such that dish strainer 38 hangs evenly. Turning briefly to FIG. 4, arm member 40 includes a hook member 58 at its distal end. Hook member 58 receives a band 44 which extends downwardly to common point 56, which in the illustrated embodiment is shown as a loop 60. The other four bands 44 extending from corners 54 converge at loop 60. For purposes of this specification, the term "band" or "flexible band" means a connecting element that may be easily deformed so as to allow the articles connected by it to freely move closer to one another, but has a maximum length at which it spaces apart the articles it is holding. Examples of suitable bands 44 include chains having links as shown, string, flexible wire, rope and the like. One of ordinary skill in the art would readily recognize numerous alternative materials that could be employed for bands 44.

Figure 5:
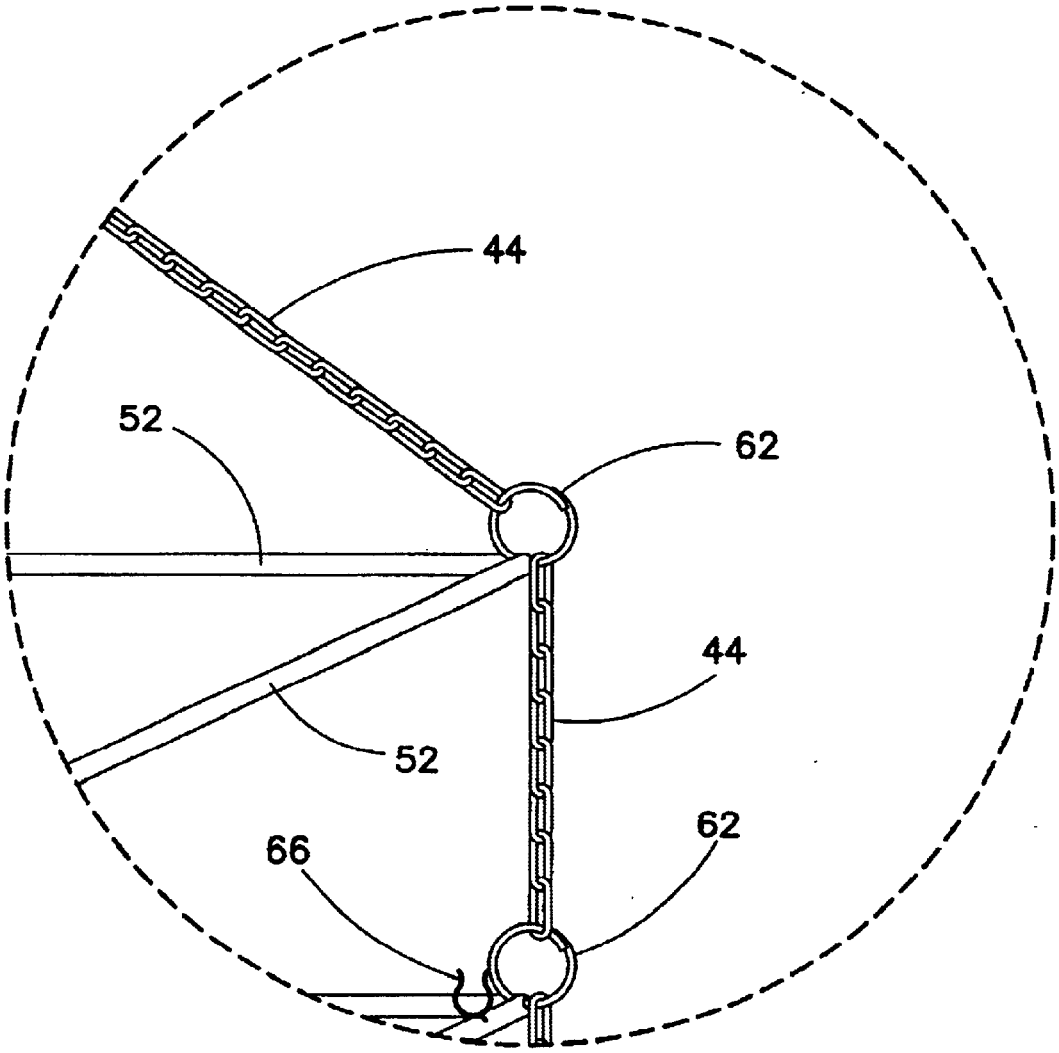
FIGS. 5 and 6 are fragmentary exploded perspective views of the connection of the racks and frame members with flexible bands and illustrating connectors in accordance with the present invention.
Figure 6:
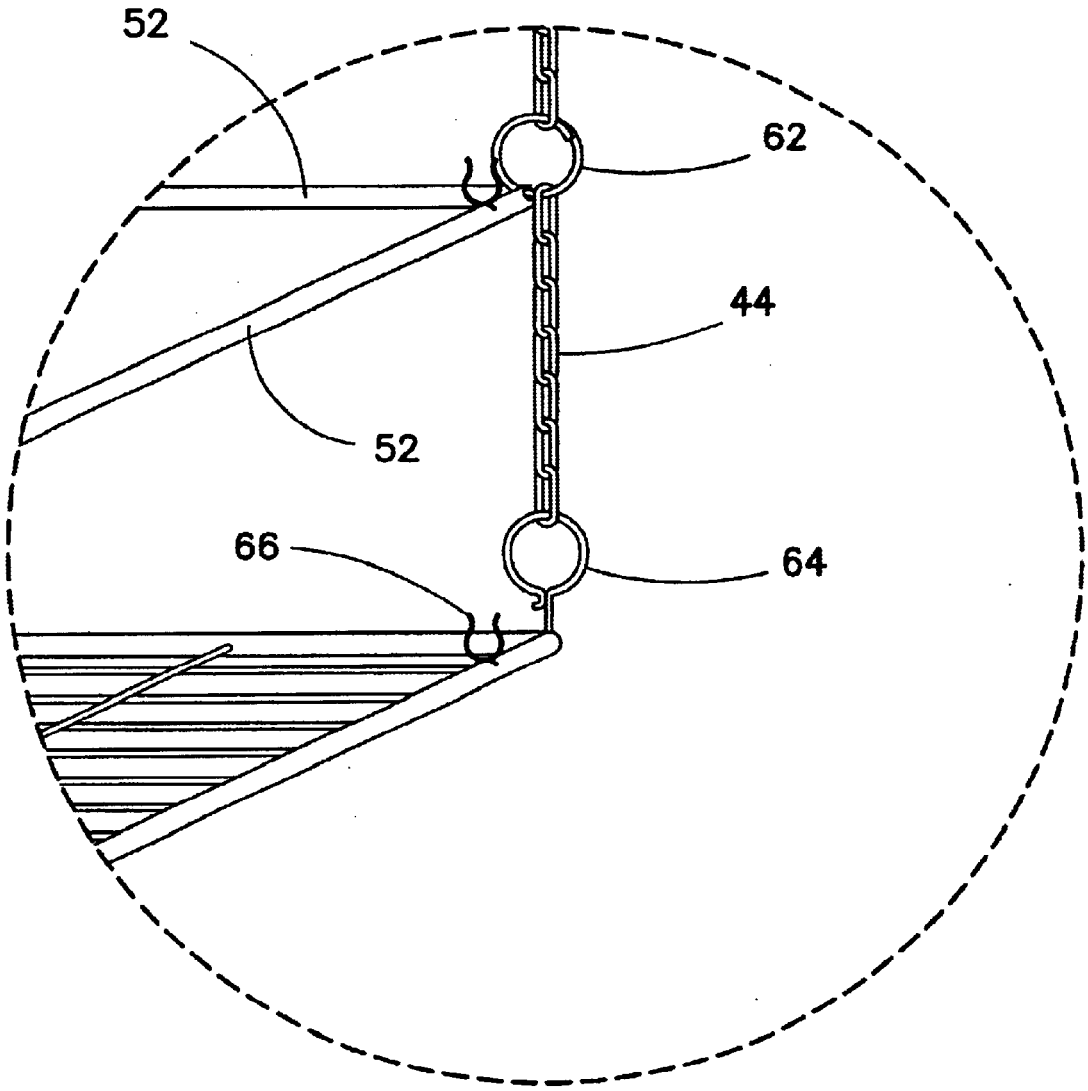
Figure 11:
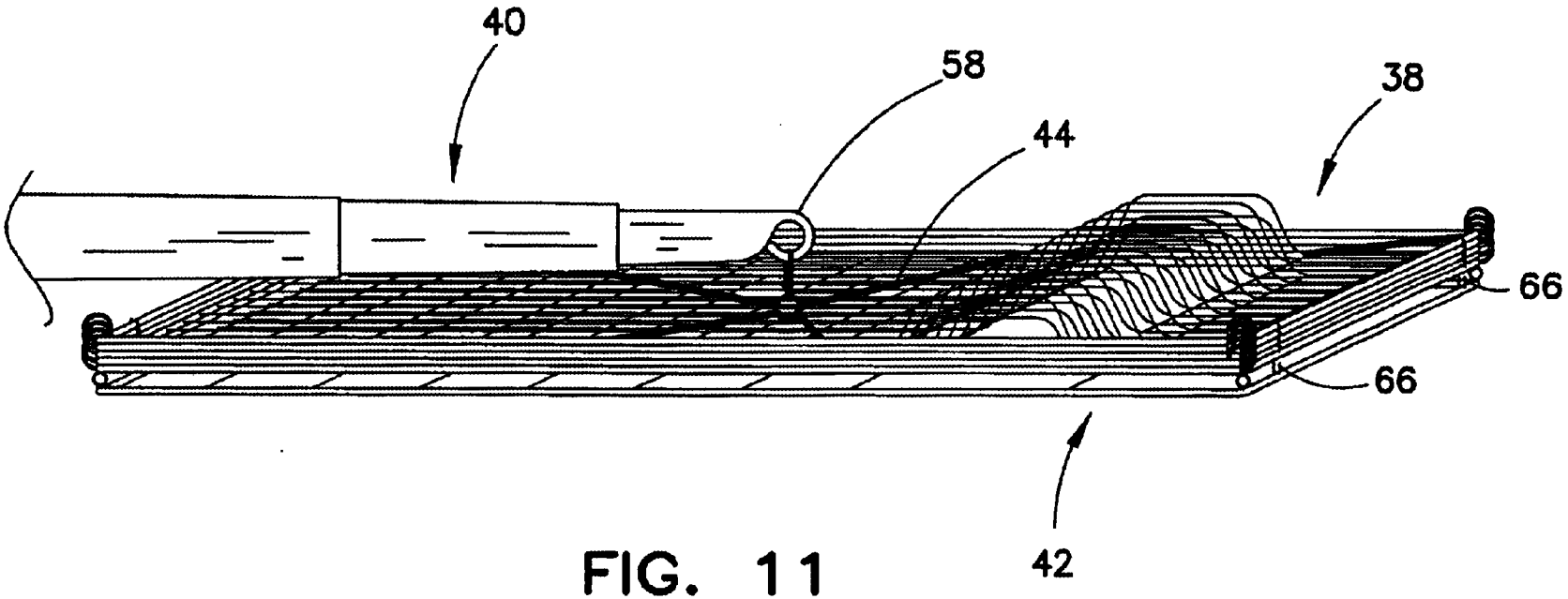
FIG. 11 is a perspective view of tile dish strainer shown in its collapsed position, the racks nested.

Returning now to FIG. 3, it can be appreciated that there are several bands 44 that are fed through substantially identical loops 62. As shown with respect to FIGS. 5 and 6, loops 64 are employed at the bottom rack 42, and are configured slightly differently than loops 62. In addition to racks 42, dish strainer 38 includes frame members 68 that are made up of individual rods 52. Frame members are important to the dish strainer because they provide a framework, as it were, for holding dishes in place when dish strainer 38 is being used. Optionally, frame members 68 may include one or more cross member 70, which may provide additional structure for holding dishes and glasses within dish strainer 38. As also shown in FIG. 3, dish strainer 38 employs several connectors 66 which hold racks 42 and frame members 68 together in the collapsed position shown in FIG. 11.

Figure 7:
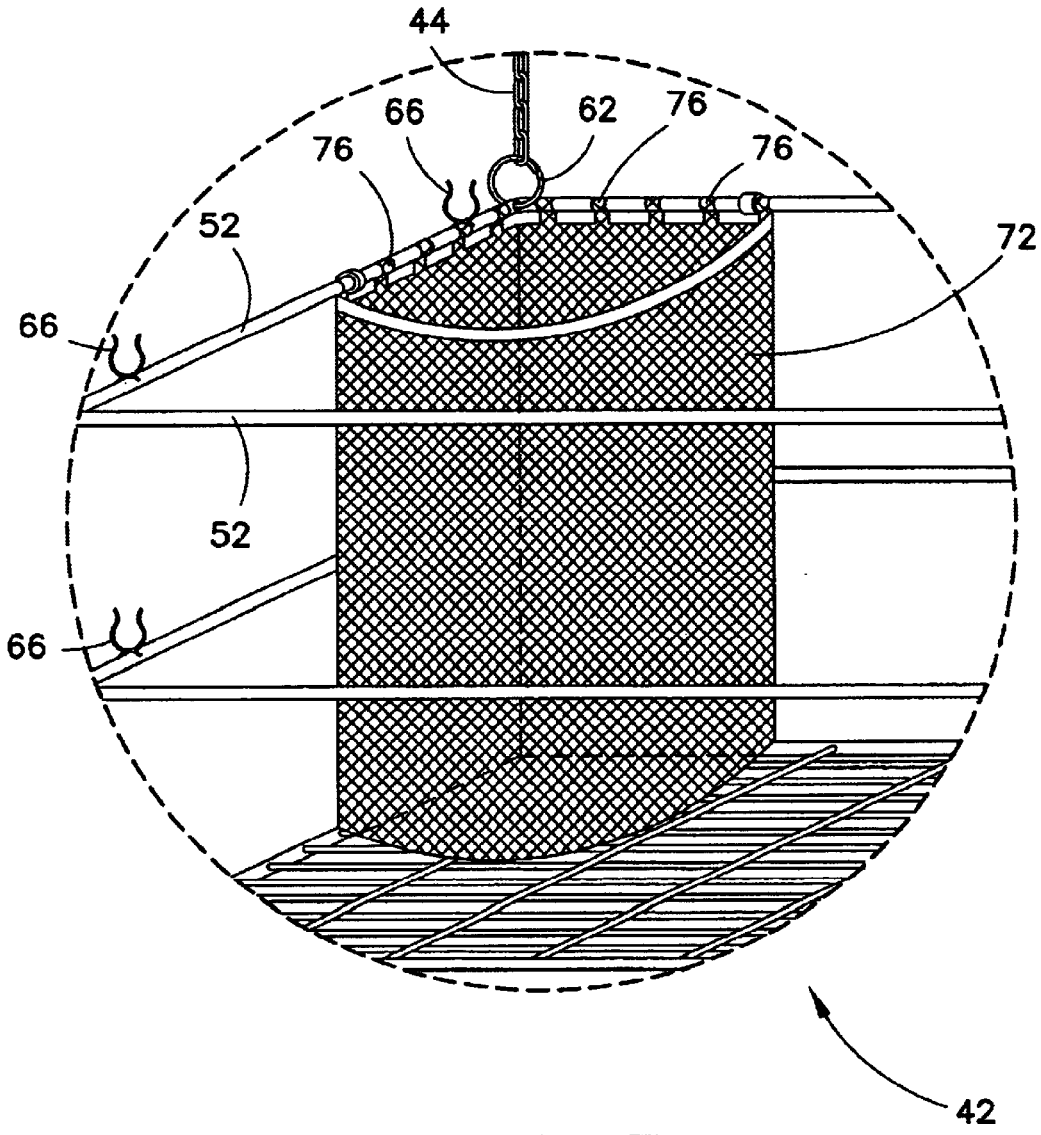
FIG. 7 is a fragmentary exploded perspective view of a collapsible basket that attaches to the dish strainer in accordance with the present invention.

With further reference to FIG. 3, dish strainer 38 includes a collapsible basket 72 having its bottom end attached to the bottom rack 42 and its top end attached to two rods 52 of one of the frame members 68. Basket 72 as shown in FIG. 7 includes a mesh which can be made of a suitable flexible polymer, such as nylon, polyester or the like. Portions of the mesh 74 arc wrapped around rods 52 as shown at 76. Basket 72 provides a convenient area to store and dry flatware.

Figure 8A:
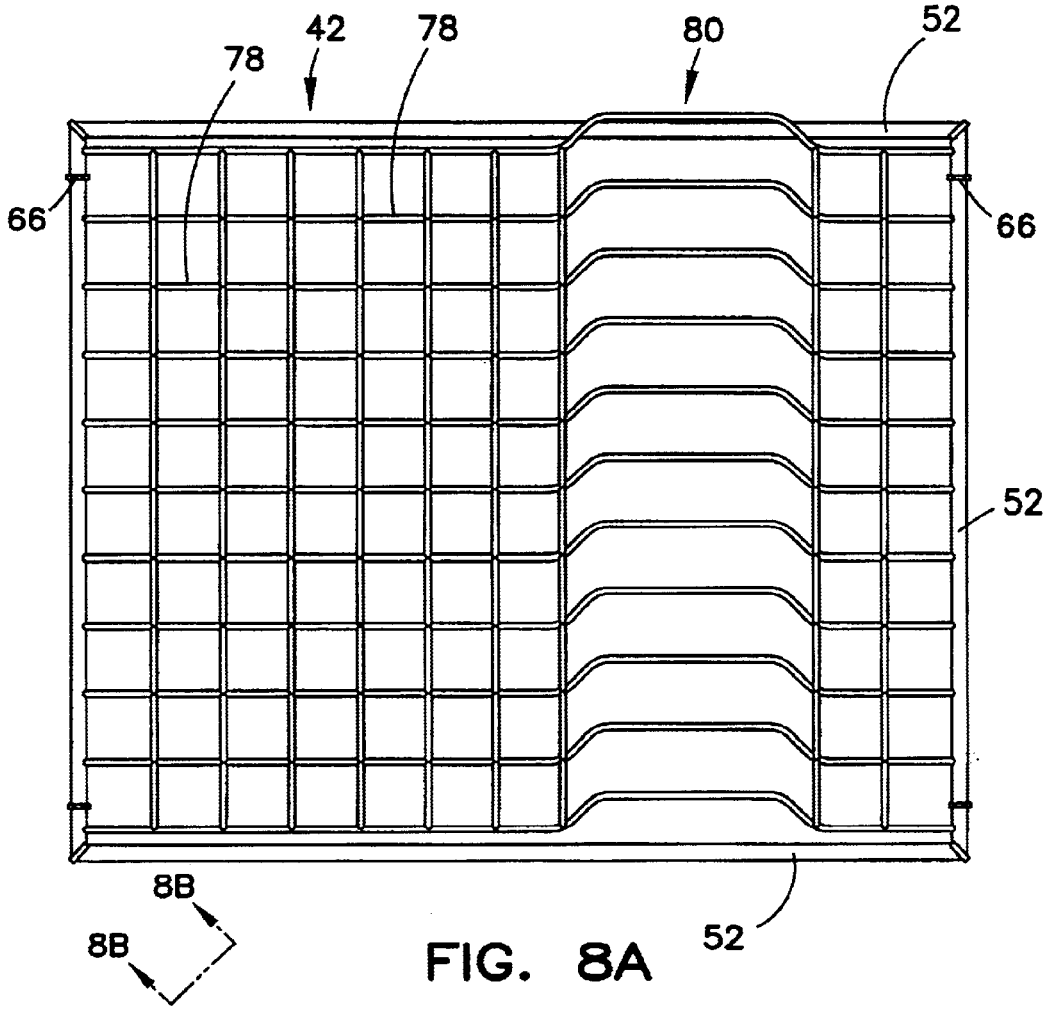
FIG. 8A is a top view of a dish strainer rack in accordance with the present invention.
Figure 8B:
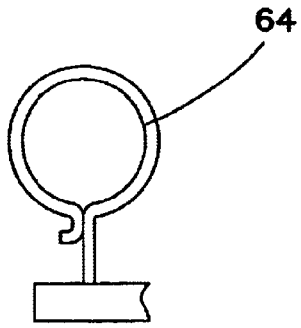
FIG. 8B is a side view of a loop which is provided at the corners of the dish strainer racks in accordance with one embodiment of the present invention.

Turning now to FIG. 8A, rack 42 is made up of a grid of preferably plastic coated wires 78 having an upstanding section 80 which holds dishes in place. One of ordinary skill in the art would readily appreciate that many different configurations for rack 42 could be employed and many plastic coated wires are commercially available. The primary consideration for racks 42 is that they be nestable, such that the collapsed configuration shown in FIG. 11 can be achieved. Each rack 42 has a periphery defined by rods 52, similar to frame members 68. Any cross bars or members 70 on frame members 68 must be position such that they do not interfere with the nesting of extended portions, such as upstanding section 80.

Figure 10A:
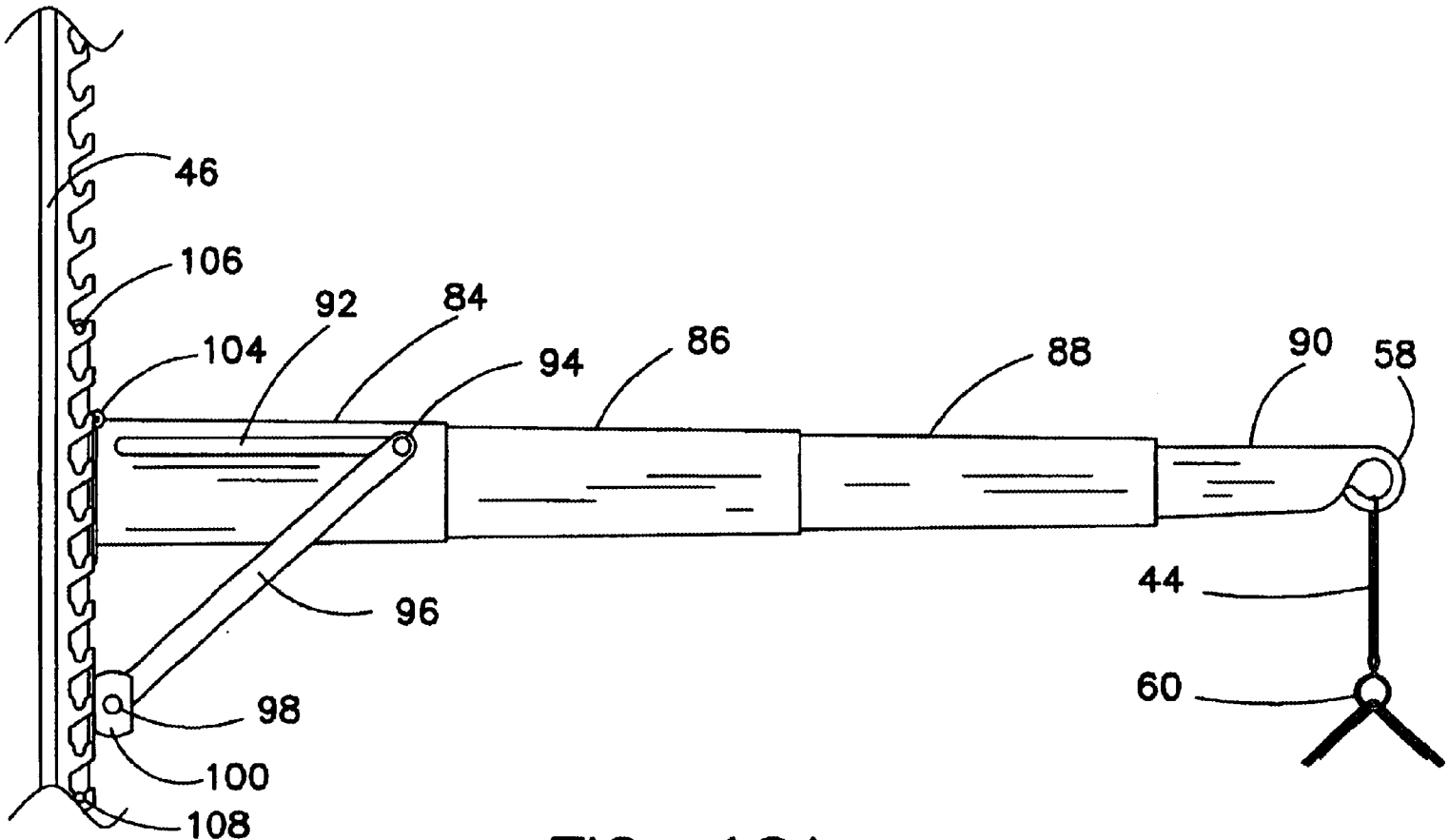
FIGS. 10A and 10B are side views illustrating an arm member in accordance with one embodiment of the present invention.
Figure 10B:
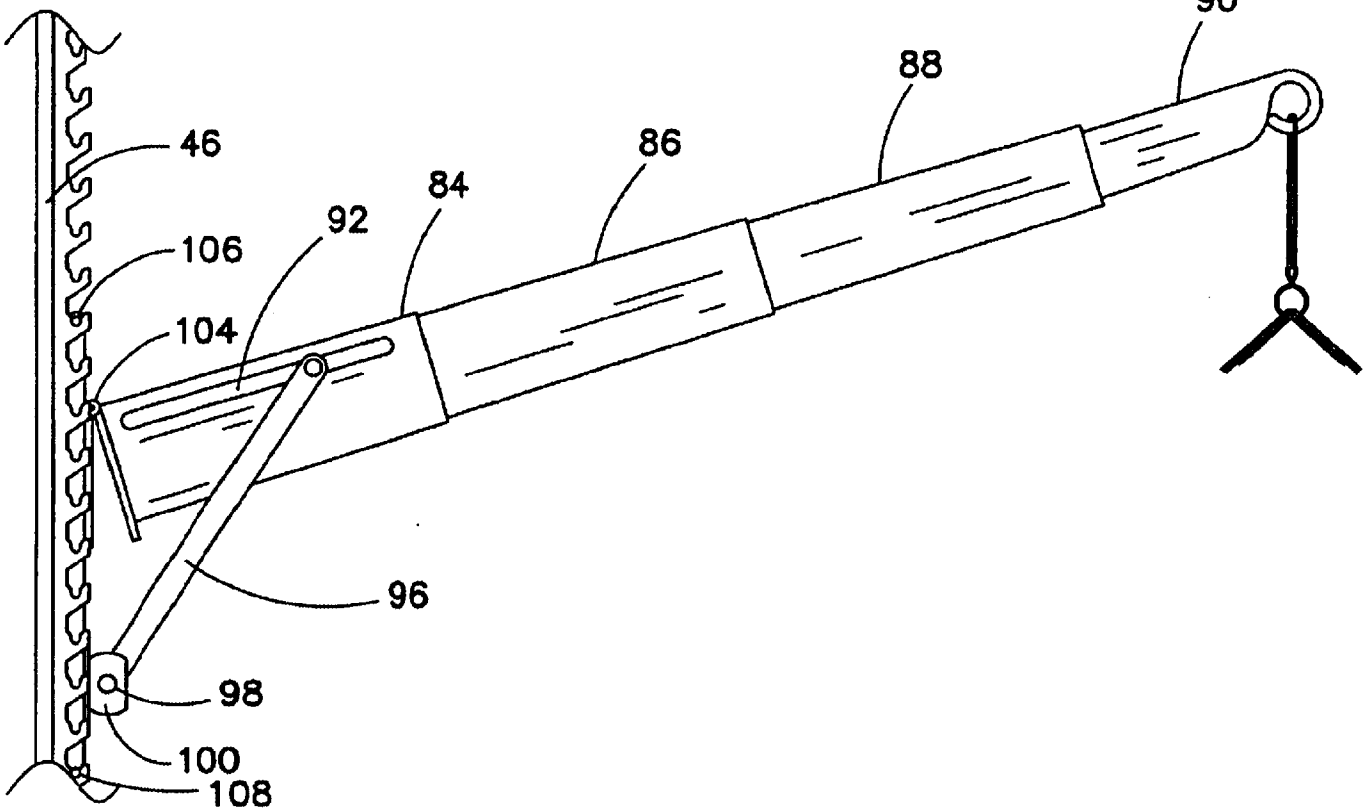

Turning now to FIGS. 10A, 10B, 12 and 13, the pivotable and vertically adjustable features of the novel arm member 40 of the disclosed embodiment can be appreciated. As shown, arm member 40 includes telescopic sub-members 84, 86, 88 and 90, member 90 terminating in hook 58 (also see FIG. 4.). Arm member 40 and its sub-members may be formed of suitable plastic or metal, the former being preferable from a cost standpoint. As shown in FIG. 10A, member 84 includes a slot 92 that slidably receives cylindrical bar 94 which is attached to support member 96, which helps support area member 40 w hell it is fully extended. The bar 94 slides in slot 92 when the arm member 40 is pivoted upwardly as shown in FIG. 10B. Support 96 is coupled to bearing 100 which rotatably houses cylindrical bar 98 as arm member 40 pivots about hinge assembly 104.

Figure 12:
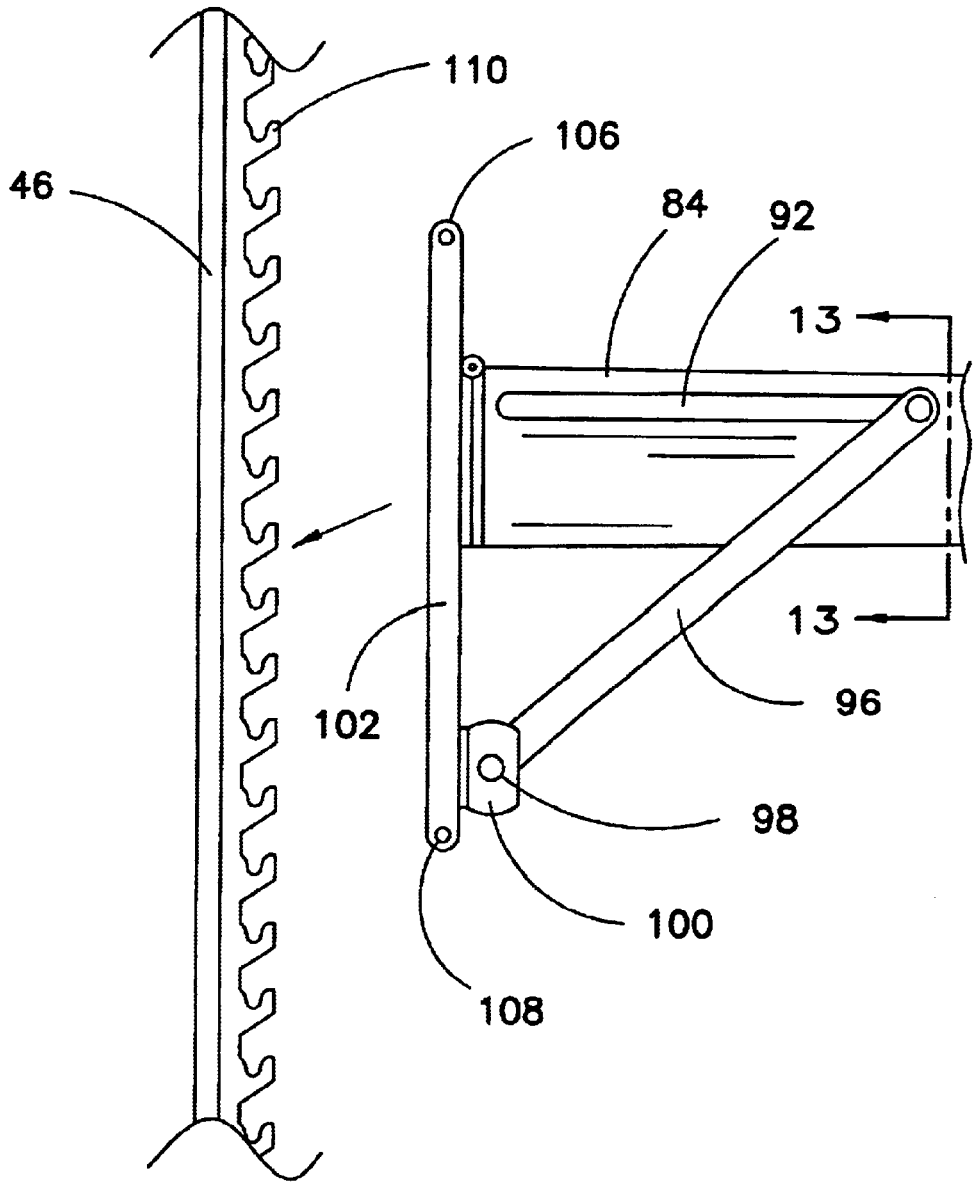
FIG. 12 is a side view illustrating the vertical adjustment assembly for the arm member in accordance with the present invention.
Figure 13:
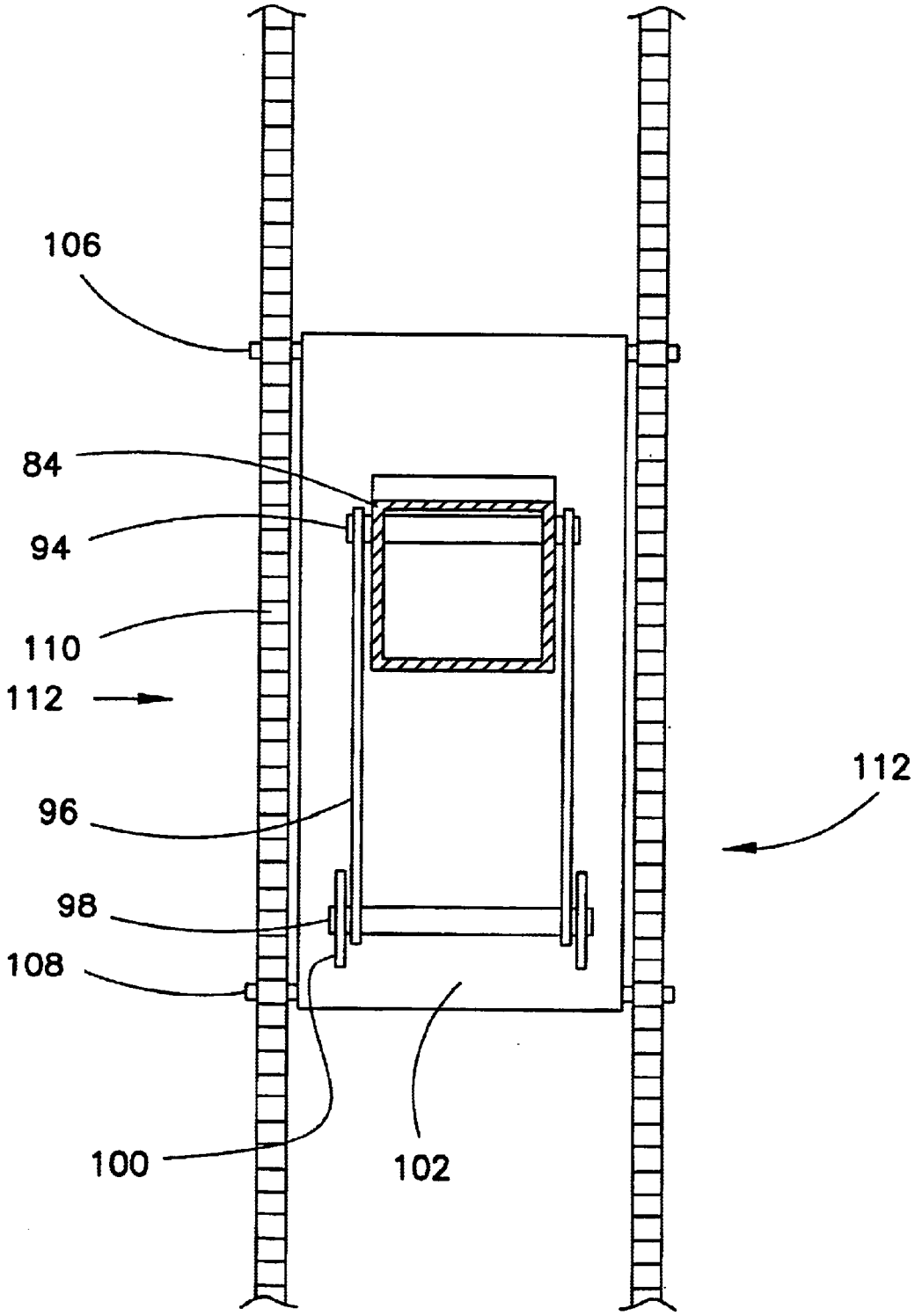
FIG. 13 is a front view illustrating the assembly of FIG. 12.

As shown with particular reference to FIGS. 12 and 13, bearing 100 is attached to plate 102 and arm member 40 is pivotably attached to plate 102 by means of hinge assembly 104. Plate 102 includes upper and lower rods 106 and 108 (FIG. 12) which are received into teeth 110 of toothed track 112. In this manner, the entire arm member assembly is pivotable (compare FIGS. 10A and 10B) and vertically and horizontally adjustable with respect to cabinet 22. This is a significant advantage of embodiments incorporating the present invention because it greatly improves versatility. For example, the location of wall 26 (FIG. 1) vis-à-vis sink 32 may vary from one installation to the next. However, the telescopic and vertically adjustable arm member allow the dish strainer 38 to nonetheless be placed directly over and aligned with sink 32.

While a preferred embodiment incorporating the principles of the present invention has been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dish drying apparatus, comprising:

a cabinet;

a dish strainer movably attached to said cabinet;

said dish strainer further comprising a plurality of nestable racks connected to one another;

said dish strainer having a storage position in which said racks are nested and said strainer is disposed within the confines of said cabinet; and said dish strainer having a use position in which said racks are spaced apart and disposed exteriorly of said cabinet;

whereby, dishes may be supported on said dish strainer in said use position and said strainer may be stored within said cabinet in said storage position.

2. The dish drying apparatus of claim 1, further comprising an arm member having a first end thereof pivotably attached to an inside wall of said cabinet and having a second end thereof attached to said dish strainer, said dish strainer hanging from and supported by said arm member in said use position.

3. The dish drying apparatus of claim 2, wherein said arm member is extendable.

4. The dish drying apparatus of claim 2, wherein said first end of said arm member is vertically adjustable with respect to said cabinet, whereby the height of said dish strainer can be adjusted.

5. The dish drying apparatus of claim 2, wherein said cabinet comprises a latch fixed thereto which releasably engages said arm member.

6. The dish drying apparatus of claim 1, wherein said cabinet further comprises a door and wherein in said storage position of said dish strainer said door is positionable in a closed position, whereby said dish strainer is concealed within said cabinet.

7. The dish drying apparatus of claim 1, further comprising a collapsible basket disposed intermediate two of said racks.

8. The dish drying apparatus of claim 1, wherein said racks comprise connectors which detachably hold said racks together.

9. The dish drying apparatus of claim 1, wherein said dish strainer further comprises a frame member disposed intermediate two of said racks.

10. A dish drying apparatus, comprising:

a dish strainer comprising a plurality of racks connected to one another by flexible bands, said racks having a use position in which said racks are spaced apart and a storage position in which said racks are nested; and a connector associated with said racks, said connector detachably holding said racks together in said storage position.

11. The dish drying apparatus of claim 10, wherein said racks define a periphery having a plurality of corners, one of said bands extending from each one of said corners, respectively, and converging at a common point disposed centrally with respect to said racks.

12. The dish drying apparatus of claim 11, wherein said common point comprises a loop adapted to receive a hook.

13. The dish drying apparatus of claim 10, wherein said racks are substantially identical.

14. The dish drying apparatus of claim 10, wherein said racks define a periphery having a plurality of corners, said dish drying apparatus further comprising a frame member disposed intermediate two of said racks and connected thereto by at least one of said bands, said frame member substantially aligned with said periphery.

15. The dish drying apparatus of claim 14, further comprising a collapsible basket having a bottom thereof attached to the bottom one of said two racks and a top end attached to said frame member.

16. A dish drying apparatus, comprising:

a cabinet;

a dish strainer movably attached to said cabinet;

said dish strainer further comprising a plurality of racks connected to one another;

said dish strainer having a storage position in which said racks are disposed within the confines of said cabinet and a use position in which said racks are disposed exteriorly of said cabinet; and an arm member having a first end thereof pivotably attached to an inside wall of said cabinet and having a second end thereof attached to said dish strainer, said dish strainer hanging from and supported by said arm member in said use position.

17. The dish drying apparatus of claim 16, wherein said arm member is extendable.

18. The dish drying apparatus of claim 16, wherein said first end of said arm member is vertically adjustable with respect to said cabinet, whereby the height of said dish strainer can be adjusted.

19. The dish drying apparatus of claim 16, wherein said cabinet comprises a latch fixed thereto which releasably engages said arm member.

20. The dish drying apparatus of claim 16, wherein said racks comprise connectors which detachably hold said racks together.

* * * * *